US007877962B2

(12) United States Patent
Teffenhart, Jr.

(10) Patent No.: US 7,877,962 B2
(45) Date of Patent: Feb. 1, 2011

(54) SYSTEM AND METHOD HAVING AN IMPROVED SELF-MATING BEAM

(76) Inventor: Thomas Joseph Teffenhart, Jr., 851 Siesta Key Cir., Sarasota, FL (US) 34242

( * ) Notice: Subject to any disclaimer, the term of this patent is extended or adjusted under 35 U.S.C. 154(b) by 0 days.

(21) Appl. No.: 12/015,117

(22) Filed: Jan. 16, 2008

(65) Prior Publication Data

US 2009/0178360 A1 Jul. 16, 2009

(51) Int. Cl.
*E04C 3/32* (2006.01)
*E04C 3/30* (2006.01)
*E04B 1/19* (2006.01)

(52) U.S. Cl. ..... 52/844; 52/845; 52/831; 52/273; 52/63

(58) Field of Classification Search ..... 52/831, 52/836, 844, 845, 63, 222, 273
See application file for complete search history.

(56) References Cited

U.S. PATENT DOCUMENTS 3,143,165 A * 8/1964 Lewis et al. ..... 160/394
3,222,841 A * 12/1965 Lipof ..... 52/482
3,382,639 A * 5/1968 Smith et al. ..... 52/844
3,413,775 A * 12/1968 Katz ..... 52/834
4,057,941 A * 11/1977 Schwartz ..... 52/63
4,774,790 A * 10/1988 Hopper ..... 52/86
5,031,083 A * 7/1991 Claesson ..... 362/249
5,813,641 A 9/1998 Baldwin
6,092,348 A 7/2000 Dombchik et al.
6,385,941 B1 5/2002 Power, Jr. et al.
6,430,888 B1 8/2002 Dombchik et al.
6,601,362 B1 * 8/2003 Prince ..... 52/844
6,668,495 B1 * 12/2003 Prince ..... 52/63
6,755,004 B1 * 6/2004 Power et al. ..... 52/845
6,826,885 B2 * 12/2004 Raskin et al. ..... 52/844
7,568,323 B2 * 8/2009 Shelton et al. ..... 52/844
2007/0074480 A1 * 4/2007 Kleila et al. ..... 52/720.1
2007/0266671 A1 * 11/2007 Chromy ..... 52/731.3
2008/0016816 A1 1/2008 Kim
2008/0168738 A1 * 7/2008 Shelton et al. ..... 52/650.1

* cited by examiner

*Primary Examiner*—Brian E Glessner
*Assistant Examiner*—Jason Holloway
(74) *Attorney, Agent, or Firm*—Jacox, Meckstroth & Jenkins

(57) ABSTRACT

A system and method for providing a stronger lanai, area or pool enclosure. The system utilizes a beam having an interior channel that provides increased thread receiving surface for receiving one or more fasteners and an interlocking joint for further strengthening the connection between a plurality of beam members that form the beam.

57 Claims, 4 Drawing Sheets

20
41
38
44a
22b
22b1
40
A
34
22b
24a1
B
26
34a
34b
24a2
22b2
24
F
E
16
22
CA
22c
24c
38
22a1
C
28
22a2
24b2
34a
28a
34
34b
26
30a
30
D
24b1
24b
42
22a
40

38
44a
58
48
44
22b
22b1
22b2
16
24a2
28
30
54
50a
50
40
24a
24a1
28a
30a
26
32
26
24
22
22c
24c
38
52
52a
56
24b2
58
24b
24b1
22a
28a
28
22a1
22a2
26
32
26
30a
30
42a
TW
46
42
40

SYSTEM AND METHOD HAVING AN IMPROVED SELF-MATING BEAM

BACKGROUND OF THE INVENTION

1. Field of the Invention

This invention relates to a lanai system, and more particularly, to a system that utilizes a beam having improved strength and durability.

2. Description of the Related Art

From its infancy stages, the aluminum enclosure industry and patio screen enclosure roof systems were fabricated with a product known as I beams. Although these I beams were structurally sound in nature, there were several recurring application problems with this type of product. For example, the I beams were cumbersome to install, aesthetically unpleasing to the home owner, and sometimes the I beam could not be configured to all applications needed in the industry. The I beam product was ultimately replaced by a product known today as a box beam.

A typical prior art box beam is shown in FIG. 1 comprising two identical halves A and B. The halves simply overlapped as shown and were stitched or screwed together with a plurality of screws C to make one complete self-mating beam D.

One problem with the prior art box beams is a high failure rate during strong winds, especially hurricane-force winds. The box beam failed for many reasons, including the fact that the beam web was simply overlapped and laid on top of each other as illustrated in FIG. 1 with nothing to hold them together except the screw C.

Note that the fasteners only penetrated the thickness of the beams, which meant that the thread-engagement surface for the screws to bite or thread into was the wall thickness of the beam, thereby limiting strength, particularly with thin-walled beams.

It was also not uncommon that the fastener C would not be placed in the direct center of the beam during installation, but would cause a non-conforming attachment problem in that the securing strength would not be the same along the length of the beam.

During high winds or hurricane conditions, the webs edge of the historical box beam will deflect, causing and creating failure in the enclosure. Once this deflection occurs, the fasteners start to pull out of the web of the beam resulting in partial or complete enclosure failure or destruction.

Self-mating beams of the type shown in FIG. 1 are manufactured with the same standards, causing ongoing potential failures, especially as the beams get longer and have to carry heavier loads. Bigger and heavier beams have been created; however, the technology for extruding and installation of these products is the same, resulting in ongoing failures.

Some homeowners or builders are building larger and more dynamic pool enclosures and lanais with the same historical products, resulting in increased failure rates, especially during high winds in hurricane seasons.

Unfortunately, as enclosure sizes increase the box beams that were used to make the enclosures had to be made with much thicker and heavier extrusions in order to achieve the span lengths desired. Unfortunately, these extrusions were much more expensive and resulted in increased failure rates and actually resulted in increased costs.

There is, therefore, a need to provide an improved box beam that overcomes one or more problems of the prior art.

SUMMARY OF THE INVENTION

One object of the invention is to provide an improved box beam.

Another object of the invention is to provide a stronger box beam.

Another object of the invention is to provide a stronger box beam that has an aesthetically pleasing appearance.

Another object of the invention is to provide a box beam having an interior track that provides more threadable area for receiving one or more fasteners.

Another object of the invention is to provide a beam having an improved interlocking joint, such as a dovetail joint.

Another object of the invention is to provide the aforementioned interior track with an interlocking joint.

Another object of the invention is to provide an indicia, groove, or mark on an outside of the beam that ensures correct and consistent fastener placement during installation.

In one aspect, one embodiment of the invention comprises a beam for an outdoor enclosure, the beam comprising a first elongated member, a second elongated member, the first and second elongated members being adapted to be coupled together to provide the beam and an interior track on at least one of the first elongated member or the second elongated member, the interior track defining a channel or opening for receiving and supporting at least one fastener for securing the first and second elongated members together.

In another aspect, another embodiment of the invention comprises a beam comprising a first beam member, a second beam member, each of the first and second beam members comprising a generally U-shape having a first portion, a second portion and a middle portion joining the first and second portions, the first and second beam members being adapted to be coupled together such that the second portions of the first and second beam members overlap the first portions of the second and first beam members, respectively, and an inner surface of the first portion of at least one of the first beam member or second beam member including at least one fastener support at every 16" to 24" intervals for receiving a fastener that is screwed into the beam.

In still another aspect, another embodiment of the invention comprises a system for enclosing or covering an outdoor area, the system comprising a plurality of beams coupled to provide a frame onto which a screen may be mounted, each of the plurality of beams comprising, a first elongated member, a second elongated member, the first and second elongated members being adapted to be coupled together to provide each beam and an interior track on at least one of the first elongated member or the second elongated member, the interior track defining a channel or opening for receiving and supporting at least one fastener for securing the first and second elongated members together.

In still another aspect, another embodiment of the invention comprises a method for providing an improved enclosure, comprising the steps of providing a plurality of support members that make up a track comprising an interlocking joint and an interior groove, enabling a user to interlock the support beams together and providing an interior U-shaped integral track for threadably receiving a fastener to further facilitate interlocking the support members together.

In yet another aspect, another embodiment of the invention comprises a beam for an outdoor enclosure, the beam comprising first and second elongated members, each of the elongated members having a generally U-shaped cross-section including first and second leg portions and an intermediate portion that joins the first and second leg portions, each of the first leg portions having a first acute angled groove on an outer surface of the first leg portions and each of the second leg portions having a second acute angled groove on an inner surface of the second leg portions, the second leg portions of the first and second elongated members overlapping the first leg portions of the second and first elongated members, respectively, with the acute angled grooves of the first and second leg portions of each of the elongated members receiving correspondingly angled outer ends of the second and first leg portions of the other of the elongated members to provide interlocking dovetail joints between the elongated members.

In still another aspect, another embodiment of the invention comprises a self-mating beam comprising a first elongated member, a second elongated member, and the first and second elongated members being adapted to comprise an interlocking joint when they are mated together.

These and other objects and advantages of the invention will be apparent from the following description, the accompanying drawings and the appended claims.

BRIEF DESCRIPTION OF THE ACCOMPANYING DRAWINGS

Figure 5:
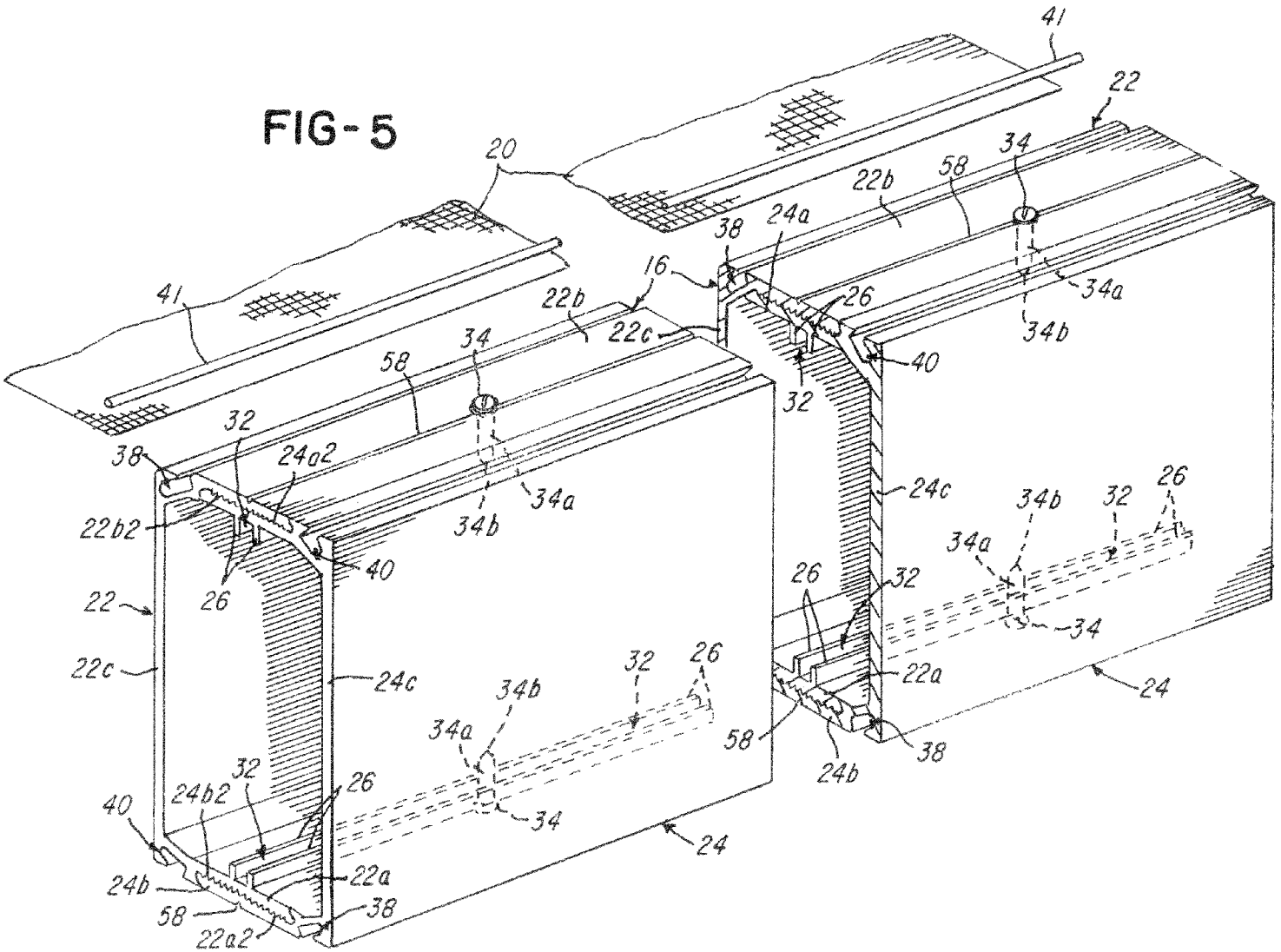
Figure 6A:
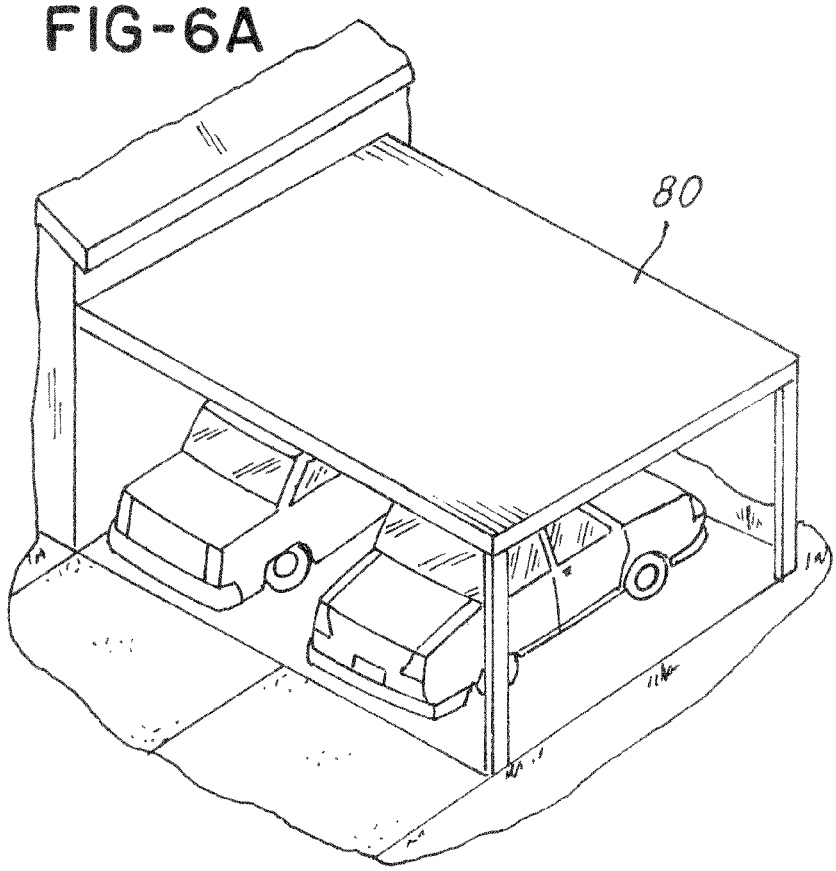
Figure 6B:
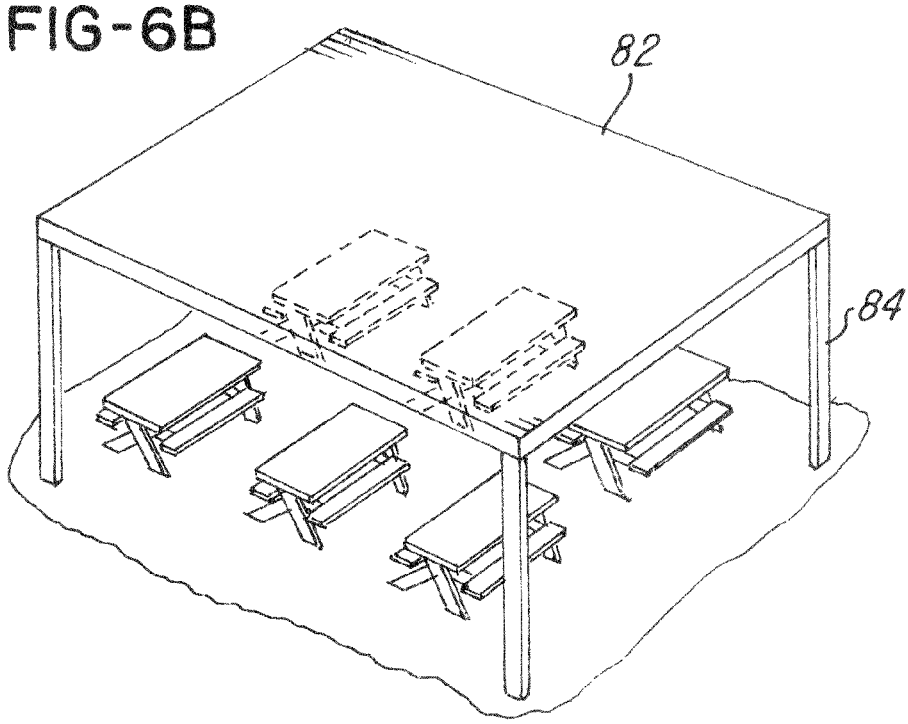

FIG. 5 is a sectional view of the beam showing, among other things, an indicia or groove for providing an alignment or guide for screwing the fasteners into the beam, the interior groove, as well as an exploded view of the positioning of a textile or screen relative to a screen receiving channel; and FIGS. 6A and 6B are illustrations showing use of the beam in one other illustrative application of a covering, such as a car port, illustrating improved spanability of the beam.

DETAILED DESCRIPTION OF THE PREFERRED EMBODIMENTS

Figure 2:
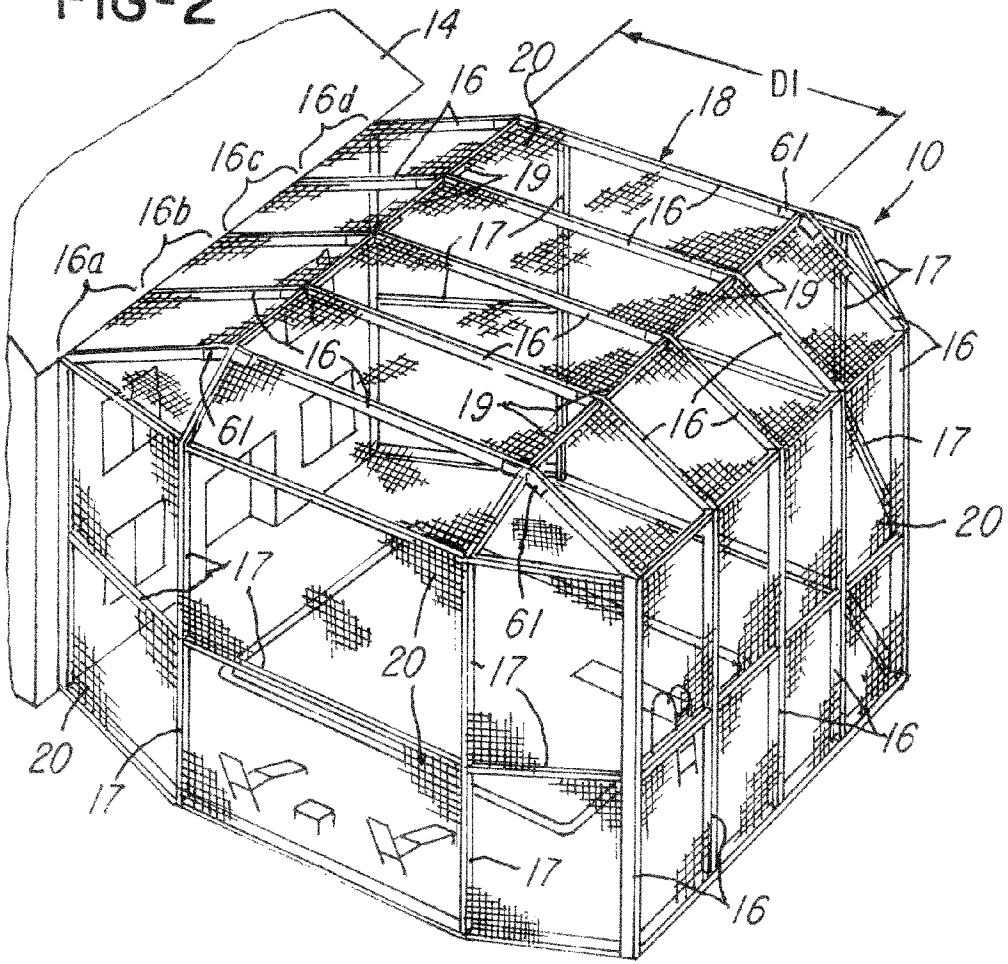
FIG. 2 is a view of a patio or pool enclosure in accordance with one embodiment of the invention.
Figure 1:
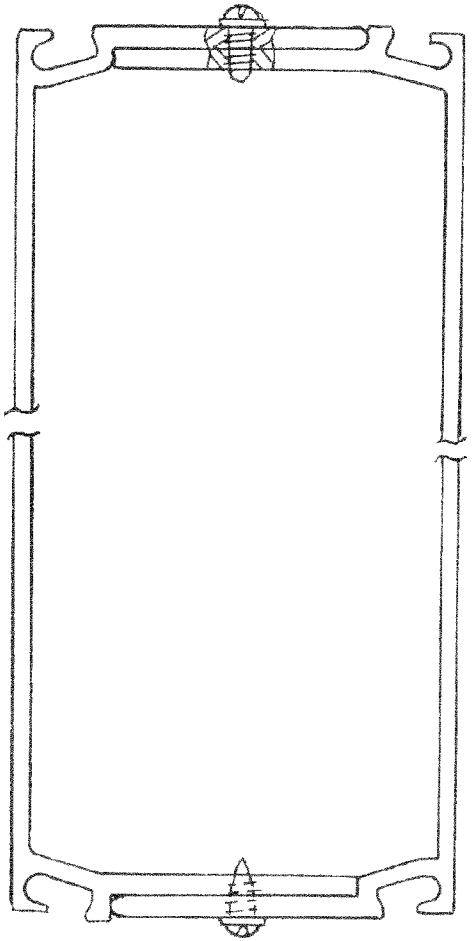
FIG-1 (PRIOR ART)
FIG. 1 is a view of a prior art box beam.

Referring now to FIG. 2, a system 10 is shown in accordance with one embodiment of the invention. The system 10 is ideally suited to encase at least a portion of an area 12, such as a pool area or patio area adjacent a building or structure, such as a dwelling or house 14. The system 10 is ideally suited for an outdoor area, but could be used inside a building or structure if desired.

In the illustration being described, the system 10 comprises a plurality of beams 16, such as track beams, wall beams, floor beams, roof beams, structural beams or the like and frame members 17 that are coupled together to provide a frame 18 onto which a textile or material, such as a screen 20, may be affixed by conventional means. The features of the invention can be used with center beams, roof members, wall members, floor beams, side beams, wall beams and the like. The beams 16 may also be used as or in the same manner or environment that any self-mating beam was used in the past, such as a center beam, side beam, roof beam, carrier beam, uprights or posts.

Figure 4:
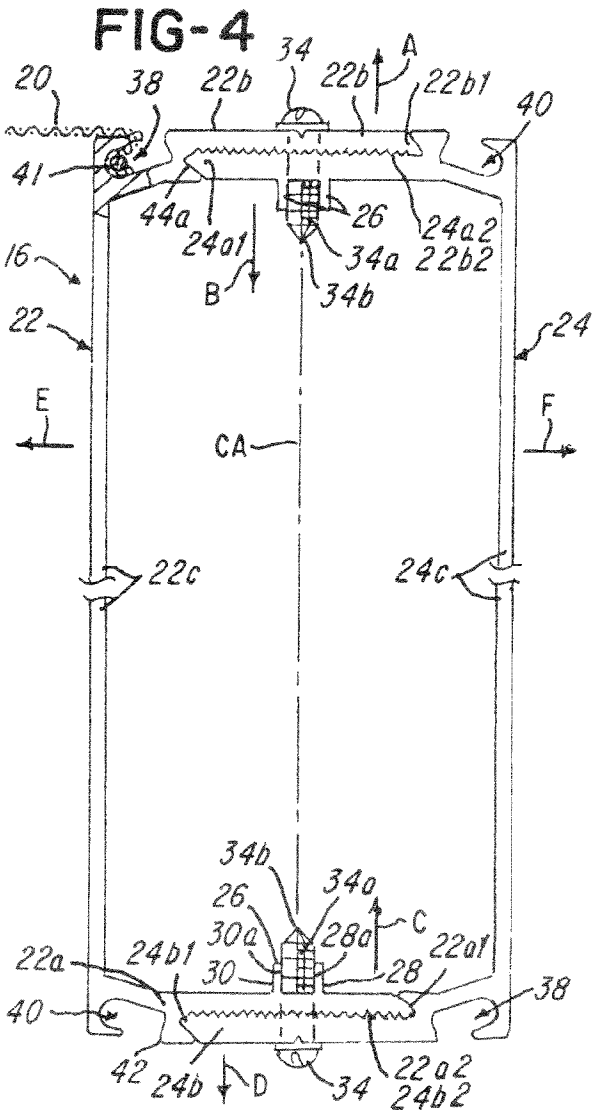
FIG. 4 is an assembled view of the first and second members, illustrating the interlocking or dovetailed joint and a plurality of fasteners screwed into an interior channel in the beam.
Figure 3:
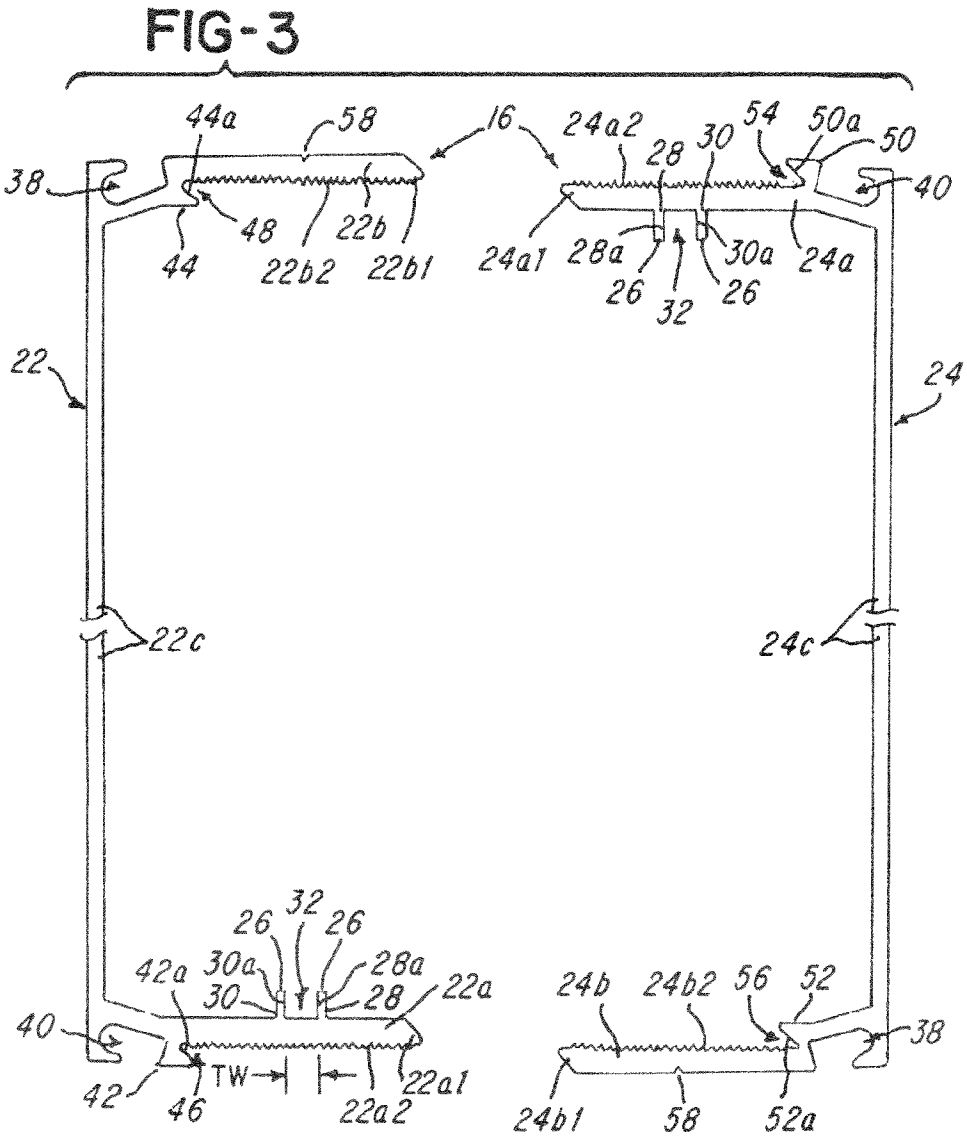
FIG. 3 is an exploded view of a beam in accordance with one embodiment of the invention showing a first member and a second member that is a mirror image of the first member except that it is inverted.

Referring now to FIGS. 3-5, it should be understood that it may be desired to provide one or more beams 16 that span long distances D1 (FIG. 2), such as distances greater than, for example, 20 feet. One advantage of the invention is that it provides a self-mating beam that can span longer distances D1 than prior art self-mating beams without the beams warping, deflecting, bending or encountering problems that were encountered in the past. For example, a standard prior art 2" by 6" beam would have little (i.e., only a few feet) or no spanability as a roof member. In contrast, using features of the embodiment being described, a 2" by 6" beam can span a distance D1 in excess of about 15 or even 20 feet. This enables or facilitates using such beam 16 in place of a much heavier roof beam of the prior art. To achieve such objective, the invention utilizes the beam 16 which will now be described relative to FIGS. 3-5.

For ease of illustration and description, a single beam 16 will be described, but it should be understood that the frame 18 may be comprised of one or more of the beams 16, or the beams 16 may be used with other conventional frame supports and components. The beams 16 may be fabricated or assembled into a truss or structural frame 18 using conventional gussets (not shown for ease of illustration). A 2" by 6" beam 16 may span 15 feet, whereas a 2" by 9" beam 16 might span 45 feet. The beams 16 of the present invention may be used to do jobs that require large span lengths D1 (FIG. 2) than what could be done with the same size beam of the past. Thus, the beam 16 enables wider spanability, improved strength and the ability to accommodate greater lengths, yet with less weight. The beam 16 provides improved interlocking of mating halves (described later herein) which in turn, improves spanability of the beam 16. The improved interlocking joint also enables manufacturing a lighter beam that enables the manufacture and assembly of larger frames 18 that cover larger areas to be screened in or enclosed.

Each of the beams 16 comprises a first member 22 and a mating overfitted and interlocking second member 24. The second member 24 is a mirror image of the first member 22, but inverted relative to the first member 22 as shown. As illustrated in FIGS. 2 and 5, the beam 16 in the embodiment being described is an integral aluminum extrusion. Notice that each of the first member 22 and second member 24 is elongated and adapted to be interlocked, overfitted and coupled together to provide the beam 16. In this regard, notice that the first member 22 comprises a first leg portion 22*a*, a second leg portion 22*b* and a joining portion 22*c* that joins the first and second leg portions 22*a* and 22*b* as shown. The second member 24 comprises a first leg portion 24*a*, a second leg portion 24*b* and a joining portion 24*c* that joins the first leg portion 24*a* and the second leg portion 24*b*.

In the illustration being described, at least one of the first member 22 or second member 24 comprises an interior fastener receiving area, channel or track 26. The track 26 comprises a first elongated track wall 28 and a second elongated track wall 30 that is generally opposed and parallel to the first elongated track wall 28 as shown. In the illustration being described, the first elongated track wall 28 and second elongated track wall 30 define a channel, spline groove or area 32 for receiving a threaded shank or end of at least one or a plurality of fasteners 34. The fastener 34 require no special fastener and can be a conventional standard fastener that is conventionally used. The track walls 28 and 30 comprise surfaces 28*a* and 30*a* that provide increased thread-engaging surface area into which the fasteners 34 may be screwed. The first and second elongated track walls 28 and 30 also provide strengthening ribs that extend along the longitudinal length of the beam 16.

The interior track 26 is adapted to threadably receive and support the at least one or a plurality of fasteners 34 that are used to secure the first member 22 to second member 24. In this regard, notice that the track 26 has a dimension TW (FIG. 3) that is slightly smaller than a major diameter of a threaded shank 34*a* of fastener 34 so that at least a portion of the threaded shank 34*a* of the fastener 34 may threadably engage the surfaces 28*a* and 30*a* of the track or be secured in the track 26 when the fastener 34 is screwed into the beam 16.

The first member 22 comprises a plurality of spline grooves or screen receiving areas 38 and 40 for receiving screen 20 and screen support or spline 41 (FIGS. 4 and 5) for securing the screen 20 therein. In this regard, it should be understood that the screen 20 is wrapped around the screen support or spline 41 and enforced or inserted into the spline groove 32 in a manner conventionally known. In the illustration, the screen support or spline 41 is a thin rubber spline or tubing of the type conventionally known.

The second member 24 in the illustration being described also comprises an interior track 26 and spline groves 38 and 40. In the illustration being described, the interior track 26 on the first leg portion 24*a* of the second member 24 is substantially the same as the interior track 26 on the first leg portion 22*a*, and the spline groves 38 and 40 are the same as those on the first member 22. These parts have been labeled with the same part numbers.

As mentioned, the first member 22 and second member 24 are interfitted and overlapped so that the first leg portion 22*a* and first leg portion 24*a* are situated in adjacent and engaged relation to the second leg portions 24*b* and 22*b*, respectively, as shown. In this regard, note that ends or surfaces 22*a*1, 22*b*1, 24*a*1 and 24*b*1 are tapered, beveled, dovetailed or angled as shown.

Note that the first member 22 comprises a plurality of integral projections 42 and 44 that define the spline groves 38 and 40 and also define shaped angled or dovetailed receiving areas 46 and 48, respectively, that are adapted to compliment the shape of the surfaces 22*a*1, 22*b*1, 24*a*1 and 24*b*1. Likewise, the second member 24 comprises the projections 50 and 52 that define similar receiving areas 54 and 56, respectively. The integral projections 42, 44, 50 and 52 comprise angled surfaces 42*a*, 44*a*, 50*a* and 52*a* that cooperate with the surfaces 24*a*1, 24*b*1, 22*b*1 and 22*a*1, respectively, to provide an interlocking or dove-tail joint which facilitates locking the first member 22 and second member 24 together. The angled surfaces 42*a*, 44*a*, 50*a* and 52*a* could be, for example, 45° or any angle, configuration or adaptation that will provide an interlocking joint along the beam to prevent interlocking joint failure. In this regard, notice in FIG. 4 that the interlocking or dovetail joint facilitates preventing the second leg portion 22*b* from separating from the first leg portion 24*a* and the first leg portion 22*a* from separating from the second leg portion 24*b*. Thus, the dovetail or interlocking joint facilitates preventing the second leg portion 22*b* from moving in the direction of arrow A (FIG. 4), the first leg portion 24*a* from moving in the direction of arrow B, the first leg portion 22*a* from moving in the direction of arrow C and second leg portion 24*b* from moving in the direction of arrow D. It has been found that this interlocking or dovetailed joint provides a very strong connection or coupling of the first member 22 to the second member 24, and when used in conjunction with the fastener 34 and the interior track 26, a very rigid and locked connection or coupling is formed. Although not shown, other types of interlocking joints that do not employ the angled surfaces 22*a*1, 22*b*1, 24*a*1 and 24*b*1, but rather, provide other interlocking configurations may also be used to interlock the first member 22 to the second member 24.

Advantageously, the rigidity and strength of the connection of the first and second members 22 and 24 enables the beam 16 to span longer lengths using less material. The interlocking joint and interior track extend longitudinally and enable the first member 22 and the second member 24 to be extruded. As mentioned, the strength of the interlocking joint facilitates providing a beam 16 in larger dimensions and lighter weights, without the beam 16 bowing, deflecting, twisting or experiencing the problems of the past during use. For example, a user may be able to replace a 2" by 8" prior art beam with a 2" by 6" beam 16.

Notice in FIGS. 3 and 4 that the leg portions 22*a*, 22*b*, 24*a* and 24*b* may comprise serrated surfaces 22*a*2, 22*b*2, 24*a*2 and 24*b*2, respectively, that mate and cooperate to facilitate preventing the first member 22 from moving in the direction of arrow E (FIG. 4) and the second member 24 from moving in the direction of arrow F in the illustration.

It is important to note that the leg portions 22*b* and 24*b* comprise an indicia, mark or groove 58, which in the embodiment being described is generally v-shaped. Notice that when the first member 22 and the second member 24 are overlapped, interlocked or fitted together, the groove 58 becomes generally aligned with a center axis or plane CA (FIG. 4) of the receiving area 32. The indicia, mark or groove 58 provides an aligning guide or indicia that the user may use to align the at least one or plurality of fasteners 34 with the channel 32 so that when the at least one or plurality of fasteners 34 are screwed through the second leg portions 22*b* and 24*b*, these screws become threadably received between the track walls 28 and 30. As mentioned earlier, the track walls 28 and 30 provides more threadable surface area for the at least one or plurality of fasteners 34 to thread into, which further strengthens the fastening of the first member 22 to the second member 24.

A method of assembly will now be described relative to FIG. 5. In general, the first member 22 and the second member 24 are overfitted or interlocked together as shown in FIG. 4. After the first member 22 and second member 24 are interlocked together, a user may align an end 34*b* of at least one or a plurality of fasteners 34 with the groove 58. The user then screws each fastener 34 through the groove 58 and thereby secures the first leg portion 22*a* and first leg portion 24*a* to the second leg portions 24*b* and 22*b*, respectively, as illustrated in FIGS. 4 and 5. The user may screw a plurality of fasteners 34 along the longitudinal length of the groove 58 and beam 16, as illustrated in FIG. 5. Notice that in each case, the fastener 34 is threadably received in the interior track 26. Again, the groove 58 facilitates providing an indicia or guide by which the user can align the fastener 34 with the receiving area 32. As also mentioned earlier herein, the track walls 28 and 30 of the interior track 26 provides increased thread-engagement surface area for receiving the threaded shank 34*a* of the fastener 34. The fastener(s) 34 and the interlocking joint provide improved and stronger coupling or interlock between of the first and second members 22 and 24 in turn the beam 16 is stronger than self-mating beams of the past.

After the first member 22 and second member 24 are secured together in the manner described herein and as shown in FIGS. 4 and 5, the screen 20 and rubber tubing or screen spline 41 are inserted into the spline groves 38 and 40 in a manner conventionally known. As mentioned earlier, the beams or one or more of the sections 16*a*, 16*b*, 16*c* and 16*d* are typically fabricated or assembled into a complete or partial truss or frame 18 using conventional gussets 61 (FIG. 2). The frame 18 can then be assembled into sections, such as the sections 16*a*, 16*b*, 16*c* and 16*d*. The sections may then be transported, with or without screen 20, to a job site. During assembly, one or more sections, such as sections 16*a*, 16*b*, 16*c* or 16*d* (FIG. 6), may be assembled offsite. Holes or openings (not shown) are then drilled or provided into the trusses that will receive, for example, 2" by 2" purlings or intermediate members 19 (FIG. 2) to secure adjacent trusses together. As is known in the art, the sections 16*a*, 16*b*, 16*c* and 16*d* may be transported with the first and second members 22 and 24 fastened together for transportation. At the job site the beams 16 between each section are disassembled, leaving, for example, a first member 22 of the beam 16 with section 16*a* and the second member 24 of beam 16 with section 16*b*. The sections 16*a*, 16*b*, 16*c* and 16*d* may then be individually raised into the air and mounted on the supports, such as walls or supports 17 (FIG. 2), of the structure or frame 18.

Advantageously, the grooves 58 (FIG. 3) enable the installer to quickly and easily screw the fasteners or screws 34 into the beam 16 and into the interior track 26. This facilitates quick and easy assembly of the sections together on the job site, especially after the sections are raised in the air. The frame 18 may be constructed off-site or on-site if desired. After the frame 18 and screen 20, which may be mounted on the frame on-site or off-site, are assembled, frame 18 is then secured or mounted to the structure, such as a wall or roof of a structure, deck, lanai or patio 12, by conventional means such as screws or fasteners or the like.

Advantageously, a system and method for providing a strengthened self-mating beam 16 is provided and adapted to provide a beam that can span longer distances. This in turn means that larger lanais and patio covers may be provided. Also, longer and lighter beams may be used without the beams experiencing the problems of the past, such as warping, deflecting, twisting, bending and the like.

Advantageously, the system and method according to the embodiments described herein enabled the beam 16 to span greater lengths D1 (FIG. 2) without the need to utilize more material and thicker wall tolerances in order to accommodate any possible deflection. The interlocking joint alone or in combination with the interior groove and fastener results in a high strength beam that may provide a safer, stronger and more durable enclosure. A stronger interlock between the first and second members 22 and 24 also facilitates enabling the overall beam size, weight, material thickness and the like to be reduced. For example, FIG. 6A shows another environment for use of the beam 16, namely a wide spanning car port 80 capable of handling two or more cars without the use of center posts. FIG. 6B shows another embodiment showing a wide-spanning cover, such as a recreation or picnic area cover 82 supported by the corner posts 84.

Thus, it should be apparent that the invention provides means for adapting a self-mating beam to many different environments when large beam span lengths are required and facilitates reducing or eliminating the need for further supports, such as center posts or uprights.

Other advantages include:

a continuous interior track 26 that is extruded within the first and second members 22 and 24 that improves fastener engagement;

the continuous interior track 26 has the interlocking joint that allows and takes on the same characteristics as "tendon" similar of that found in bridge construction;

the continuous interior track 26 also provides a "double T" creating a rigid connection throughout the entire length of the extrusion, as opposed to a "flat" surface which has little strength;

all fastener threads of threaded shank 34*a* are engaged in this interior track 26, which creates a positive moment connection with each fastener 34 that is installed;

an external mark, indicia or groove on the outside of the web or beam 16 assures correct and consistent fastener 34 placement during installation;

a 45 degree angle extruded along the spline groove of the web or beam 16, creating a continuous female locking system to accept the opposing male half; and the angle provides a continuous lock down to the at least a portion or the entire length of the beam and locks them together which allows them to take on strength characteristics similar to a "hollow" profile.

The first or second members 22 and 24 are extruded aluminum and, advantageously, require no additional machining to proved the channel 32. The alloy used to make the beam 16 could be made from a higher strength alloy, such as 6005 aluminum.

The beam 16 could also be used with an adhesive system that utilizes an adhesive to bond the beam sides together.

The beam's 16 strength enables greater spanability without the use of supports as was traditionally needed, such as uprights, posts and the like. This makes the beam 16 advantageously suited for use as an enclosure or in any environment where a traditional interlocking beam was used with supports. For example, in a traditional car port or standalone roof cover, a wide span of self-mating beams was difficult without the use of support posts, such as center posts located underneath the roof. With the embodiment being described, a wider span is enabled without the use of support posts or center posts. This is illustrated in the car port illustrated in FIG. 6. Notice that no support posts are provided or necessary because of the strength of the interlocking beam 16.

While the system and method herein described constitute preferred embodiments of this invention, it is to be understood that the invention is not limited to this precise method and form of apparatus and that changes may be made in either without departing from the scope of the invention, which is defined in the appended claims.

What is claimed is:

1. A beam for an outdoor enclosure, said beam comprising:

a first elongated member;

a second elongated member;

said first and second elongated members being adapted to be interfitted and interlocked together to provide the beam; and an interior track on at least one of said first elongated member or said second elongated member, said interior track defining a channel or opening for receiving and supporting at least one fastener for securing said first and second elongated members together;

wherein each of said first and second elongated members comprise a first leg portion having a first projection that extends over a portion of said first leg portion to define a first receiving area, a second leg portion comprising a second projection that extends over less than a majority of a length of said second leg portion to define a second receiving area, and a joining portion for joining said first and second leg portions;

said first receiving area and said second receiving area being adapted to receive a free end of said second leg portion and a free end of said first leg portion, respectively, to provide said interfitting or interlocking of each of said first leg portions to said second leg portions and said second leg portions to said first leg portions when said first and second elongated members are mated or coupled together to provide said beam;

said first and second projections each comprising an angled projection surface and each of said free ends of said first and second leg portions comprising an angled end surface, said angled end surface of said first leg portion and second leg portion engaging said angled projection surfaces of said second projection and said first projection, respectfully, and causing said first and second leg portions of said first elongated member to move toward said second and first leg portions, respectively, of said second elongated member when said first and second elongated members are interfitted or interlocked together, said angled projection surfaces of said first and second projections cooperating with said angled end surfaces to facilitate preventing said first and second leg portions of said first elongated member from moving in opposite directions from said second and first leg portions, respectively, of said second elongated member.

2. The beam as recited in claim 1 wherein said interior track comprises a first track wall and a second track wall that is situated a predetermined distance from said first track wall, said at least one fastener comprises a threaded shank comprising at least a portion having a major diameter that is larger than said predetermined distance so that said at least one fastener becomes threadably received in said interior track when said at least one fastener is screwed into said beam.

3. The beam as recited in claim 1 wherein said interior track is not visible after said first and second elongated members are coupled together.

4. The beam as recited in claim 1 wherein each of said first and second elongated members include an interior track integrally formed on an interior surface thereof.

5. The beam as recited in claim 1 wherein said interior track extends along a longitudinal axis and substantially an entire length of said beam.

6. The beam as recited in claim 1 wherein said interior track defines a continuous channel that extends along substantially an entire length of said beam.

7. The beam as recited in claim 1 wherein at least one of said first and second elongated members include an indicia or groove for facilitating, or providing a guide for screwing said at least one fastener into said interior track.

8. The beam as recited in claim 1 wherein said first and second elongated members are joined together by an interlocking joint.

9. The beam as recited in claim 8 wherein said interlocking joint comprises a dovetail joint.

10. The beam as recited in claim 8 wherein said interlocking joint extends an entire length of said beam.

11. The beam as recited in claim 1 wherein each of said first and second elongated members are generally U-shaped in cross section.

12. The beam as recited in claim 1 wherein each of said first and second elongated members are generally U-shaped in cross section and comprise a first leg portion, a second leg portion and a joining portion that joins said first and second leg portions, each of said first leg portions include an inner track defining a channel that is generally parallel to a longitudinal axis of said beam.

13. The beam as recited in claim 12 wherein each of said second leg portions include an indicia on an exterior surface thereof, which is generally aligned with said interior track on said second or first elongated members, respectively, after said second or first elongated members are coupled together to facilitate screwing said at least one fastener into said interior track.

14. The beam as recited in claim 12 wherein each of said first and second elongated members is a one-piece extruded construction.

15. A beam comprising:

a first beam member;

a second beam member;

each of said first and second beam members comprising a generally U-shape having a first portion, a second portion and a middle portion joining said first and second portions, said first and second beam members being adapted to be coupled together such that said second portions of said first and second beam members overlap said first portions of said second and first beam members, respectively; and an inner surface of said first portion of at least one of said first beam member or second beam member including at least one fastener support for receiving a fastener that is screwed into said beam;

wherein each of said first and second beam members comprise a first leg portion having a first projection that extends over a portion of said first leg portion to define a first receiving area, a second leg portion comprising a second projection that extends over less than a majority of a length of said second leg portion to define a second receiving area, and a joining portion for joining said first and second leg portions, said first projection having a first angled projection surface and said second projection having a second angled projection surface;

said first receiving area being adapted to receive an end of said second leg portion and said second receiving area being adapted to receive an end of said first leg portion, thereby providing said interfitting or interlocking of each of said first leg portions to said second leg portions and said second leg portions to said first leg portions when said first and second beam members are mated or coupled together to provide said beam; and said ends of said first and second leg portions each comprising an angled surface, said angled surface of said first leg portion of said first and second beam members engaging said second angled projection surface of said second projection of said second and first beam members, respectfully, and said angled surface of said second leg portion of said first and second beam members engaging said first angled projection surface of said first projection of said second and first beam members, respectfully, to urge said first and second leg portions toward each other and facilitating preventing them from separating when said first and second beam members are mated together.

16. The beam as recited in claim 15 wherein an inner surface of each first portion includes said at least one fastener support for receiving a plurality of fasteners that are screwed into said beam.

17. The beam as recited in claim 15 wherein said at least one fastener support comprises an interior track that is elongated and that lies in a plane that is generally parallel to a longitudinal axis of said beam.

18. The beam as recited in claim 17 wherein said interior track comprises a first track wall and a second track wall that is generally opposed and parallel to said first track wall, said first track wall and said second track wall situated a predetermined distance from said first track wall, at least one fastener comprising a threaded shank including at least a portion having a major diameter that is larger than said predetermined distance so that said at least one fastener becomes threadably received in said first and second track walls when said at least one fastener is screwed into said beam.

19. The beam as recited in claim 17 wherein said interior track is not visible after said first and second beam members are coupled together.

20. The beam as recited in claim 15 wherein said at least one fastener support defines a continuous channel that extends along substantially an entire length of said first and second beam members.

21. The beam as recited in claim 15 wherein at least one of said first portion or said second portion includes an indicia for facilitating or providing a guide aligning said at least one fastener support with said at least one fastener support.

22. The beam as recited in claim 21 wherein said indicia is a groove situated on an outer surface of at least one of said second portions to provide said guide for screwing said fastener into said at least one fastener support.

23. The beam as recited in claim 15 wherein said first and second beam members are joined together by an interlocking joint.

24. The beam as recited in claim 23 wherein said interlocking joint comprises a dovetail joint.

25. The beam as recited in claim 24 wherein said interlocking joint extends along a longitudinal axis and at least a majority of a length of said beam.

26. The beam as recited in claim 15 wherein each of said first and second beam members is generally U-shaped in cross section and said at least one fastener support is integrally formed in an interior surface of said beam.

27. The beam as recited in claim 15 wherein said at least one fastener support is not visible when said first and second beam members are secured together.

28. The beam as recited in claim 18 wherein each of said first portion, said second portion and said interior track comprise an integral one-piece extruded construction.

29. A system for enclosing or covering an outdoor area, said system comprising:

a plurality of beams coupled to provide a frame onto which a screen may be mounted;

each of said plurality of beams comprising:

a first elongated member;

a second elongated member;

said first and second elongated members being adapted to be coupled together to provide each beam; and an interior track on at least one of said first elongated member or said second elongated member, said interior track defining a channel or opening for receiving and supporting at least one fastener for securing said first and second elongated members together;

wherein each of said first and second elongated members comprise a first leg portion having a first projection that extends over a portion of said first leg portion to define a first receiving area, a second leg portion comprising a second projection that extends over less than a majority of a length of said second leg portion to define a second receiving area, and a joining portion for joining said first and second leg portions, said first leg portion having an integral end associated with said joining portion and a free end and said second leg portion having an integral end associated with said joining portion and a free end;

said first projection comprising a first angled projection surface and said second projection comprising a second angled projection surface;

said first receiving area and said second receiving area being adapted to receive said free end of said second leg portion and said free end of said first leg portion, respectively, to provide said interfitting or interlocking of each of said first leg portions to said second leg portions and said second leg portions to said first leg portions when said first and second elongated members are mated or coupled together to provide said plurality of beams;

said free ends of said first and second leg portions each having a free end angled surface area;

said free end angled surface of said first leg portion engaging said second angled projection surface of said second projection and said free end angled surface of said second leg portion engaging said first angled projection surface of said first projection to force said first and second leg portions toward each other when said first and second elongated members are coupled together.

30. The system as recited in claim 29 wherein said interior track comprises a first track wall and a second track wall that is situated a predetermined distance from said first track wall, said at least one fastener comprises a threaded shank including at least a portion having a major diameter that is larger than said predetermined distance so that said at least one fastener becomes threadably received in said interior track when said at least one fastener is screwed into said plurality of beams.

31. The system as recited in claim 29 wherein said interior track is not visible after said first and second elongated members are coupled together.

32. The system as recited in claim 29 wherein each of said first and second elongated members has an interior track integrally formed on an interior surface thereof.

33. The system as recited in claim 32 wherein each of said interior track extends along substantially an entire length of said first and second elongated members.

34. The system as recited in claim 29 wherein at least one of said first and second elongated members include an indicia groove for facilitating or providing a guide for screwing said at least one fastener in said interior track.

35. The system as recited in claim 29 wherein said first and second elongated members are joined together by an interlocking joint.

36. The system as recited in claim 35 wherein said interlocking joint comprises a dovetail joint.

37. The system as recited in claim 35 wherein said interlocking joint extends an entire length of said first and second elongated members.

38. The system as recited in claim 34 wherein each of said first and second elongated members, said interior track and said indicia groove are a one-piece extruded construction.

39. A beam for an outdoor enclosure, said beam comprising:

a first elongated member;

a second elongated member;

each of said first and second elongated members having a generally U-shaped cross-section including a first leg portion and a second leg portion and an intermediate portion that joins said first and second leg portions;

each of said first leg portion having a first projection having a first angled projection surface, said first projection overlaying a portion of said first leg portion to provide a first acute angled undercut groove on an outer surface of said first leg portion and each of said second leg portion having a second projection having a second angled projection surface, said second projection overlaps less than a majority of a length of said second leg portion to provide a second acute angled undercut groove on an inner surface of said second leg portion;

each of said first leg portion and said second leg portion and having an angled end that engages said second angled projection surface of said second projection and each of said second leg portion having an angled end that engages said first angled projection surface of said first projection to provide interlocking or interfitting joints for joining said first or second elongated members together;

said outer surface of said first leg portion having a first set of serrations and said inner surface of said second leg portion having a second set of serrations; and said first acute angled undercut groove and said second acute angled undercut groove being adapted to receive said angled end of said second leg portion and said angled end of said first leg portion, respectively, to provide said interfitting or interlocking of each of said first leg portion to said second leg portion and said second leg portion to said first leg portion when said first and second elongated members are mated or coupled together to provide said beam, said angled end of said first leg portion having an angled surface that engages said second angled projection surface of said second projection and said angled end of said second leg portion having an angled surface that engages said first angled projection surface of said first projection thereby forcing said first and second leg portions toward and against each other when said first and second elongated members are joined together.

40. The beam as recited in claim 39 wherein each of said acute angled undercut grooves has an included angle of between about 30° and about 60°.

41. The beam as recited in claim 40 wherein each of said acute angled undercut grooves has an included angle of about 45°.

42. The beam as recited in claim 39 wherein each of said first and second leg portions of said first and second elongated members has teeth in overlapping sides of said first and second leg portions that mesh with each other.

43. The beam as recited in claim 39 wherein said interlocking or interfitting joints form channels extending at least a majority of a length of said first and second elongated members containing a bonding adhesive for adhesively bonding said first and second elongated members together.

44. The beam as recited in claim 39 wherein an inner surface of each of said first leg portions has an interior track extending at least a majority of a length of said first and second elongated members for receiving a plurality of longitudinally spaced fasteners that are screwed through first and second leg portions, respectively, into said interior track.

45. The beam as recited in claim 44 wherein each said interior track has uniformly spaced apart track walls, and each of said fasteners has a threaded shank portion with a major diameter that is slightly larger than the spacing between said track walls so that said fasteners become threadedly received in said track walls during screwing of said fasteners through said first and second leg portions, respectively, in substantial alignment with an axial center of each said interior track.

46. The beam as recited in claim 45 wherein an outer surface of each of said second leg portions has indicia in substantial alignment with the axial center of each said interior track to facilitate screwing of said fasteners into said track walls.

47. The beam as recited in claim 46 wherein said indicia is a groove extending at least the majority of the length of said first and second elongated members to provide a guide for screwing said fasteners into said track walls during screwing of said fasteners through said first and second leg portions, respectively.

48. The beam as recited in claim 44 wherein each of said first and second elongated members is a one piece extrusion.

49. The beam as recited in claim 39 wherein said beam is assembled to form a roof over a patio area, car port area or recreation area.

50. The beam as recited in claim 39, wherein said beam is assembled to form a lanai frame or roof frame.

51. A self-mating beam comprising:

a first elongated member;

a second elongated member;

said first and second elongated members being adapted to comprise an interlocking joint when they are mated together;

wherein each of said first and second elongated members comprise a first leg portion having a first projection that extends over a portion of said first leg portion to define a first groove, a second leg portion comprising a second projection that extends over less than a majority of a length of said second leg portion to define a second groove, and a joining portion for joining said first and second leg portions, said first projection comprising a first angled projection surface and said second projection comprising a second angled projection surface; and an outer surface of said first leg portion having a first set of serrations and an inner surface of said second leg portion having a second set of serrations;

said first groove and said second groove being adapted to receive an end of said second leg portion and an end of said first leg portion, respectively, to provide said interfitting or interlocking of each of said first leg portion to said second leg portion and said second leg portion to said first leg portion when said first and second elongated members are mated or coupled together to provide said self-mating beam, said end of said first leg portion having an angled surface that engages said second angled projection surface of said second projection and said end of said second leg portion having an angled surface that engages said first angled projection surface of said first projection, thereby causing the first and second leg portions toward and against each other when said first and second elongated members are joined together and causing said first set of serrations to engage said second set of serrations.

52. The self-mating beam as recited in claim 51, wherein each of said first and second elongated members comprise a groove for receiving at least a portion of said second or first elongated members, respectively, when said first and second elongated members are mounted together, said groove and said at least a portion of said first and second elongated members cooperating to provide said interlocking joint.

53. The self-mating beam as recited in claim 52, wherein said groove is an angled groove and said at least a portion of said first and second elongated members has an angled surface that is received in said angled groove.

54. The self-mating beam as recited in claim 51, wherein an interior surface of at least one of said first or second elongated members comprises an interior track for receiving a screw.

55. The self-mating beam as recited in claim 51, wherein each of said first and second elongated members comprise an interior track that extends substantially along a longitudinal length of said self-mating beam.

56. The self-mating beam as recited in claim 51, wherein said second leg portions of said first and second elongated members overlap said first leg portions of said first and second elongated members, respectively, with said first groove and said second groove of said first and second leg portions of each of said first and second elongated members receiving portions of said first and second leg portions of the other of said first or second elongated members to provide interlocking joints between said first and second elongated members.

57. The self-mating beam as recited in claim 56, wherein each of said interlocking joints each comprise a dovetail joint.

* * * * *